US005120288A

United States Patent [19]

Sinaki

[11] Patent Number: 5,120,288

[45] Date of Patent: Jun. 9, 1992

[54] POSTURE TRAINING SUPPORT

[75] Inventor: Mehrsheed Sinaki, Rochester, Minn.

[73] Assignee: Mayo Foundation of Medical Education and Research, Rochester, Minn.

[21] Appl. No.: 579,349

[22] Filed: Sep. 6, 1990

[51] Int. Cl.[5] ..... A63B 21/00; A61F 5/02; A45F 3/04

[52] U.S. Cl. ..... 482/105; 602/19; 128/DIG. 19; 2/44; 224/209

[58] Field of Search ..... 128/78, 87 R, 869, 870, 128/874–876, DIG. 19; 272/119; 2/44, 45, 311, 312, 338; 224/153, 202, 204, 208, 209, 215, 216

[56] References Cited

U.S. PATENT DOCUMENTS

| | | | |
|---|---|---|---|
| 3,888,245 | 6/1975 | Bentson et al. | 128/78 |
| 4,332,379 | 6/1982 | Bannister | 272/119 |
| 4,394,012 | 7/1983 | Egbert et al. | 272/119 |
| 4,570,619 | 2/1986 | Gamm | 128/78 |
| 4,674,664 | 6/1987 | Simon | 224/215 |
| 4,903,874 | 2/1990 | Shoemaker | 224/207 X |
| 4,936,495 | 6/1990 | Van de Pol | 224/209 |
| 4,948,122 | 8/1990 | Andrews, Sr. | 272/119 |

FOREIGN PATENT DOCUMENTS

| | | | |
|---|---|---|---|
| 218063 | 7/1967 | Sweden | 272/119 |

*Primary Examiner*—Richard J. Apley
*Assistant Examiner*—Linda C. M. Dvorak
*Attorney, Agent, or Firm*—Price, Heneveld, Cooper, DeWitt & Litton

[57] ABSTRACT

The specification discloses a method and support for posture training. The support comprises a pouch for holding one or more weights. The pouch is positionable on the back of a patient below the inferior angle of the patient's scapulae by means of adjustable clavicle straps secured to the pouch.

17 Claims, 1 Drawing Sheet

POSTURE TRAINING SUPPORT

BACKGROUND OF THE INVENTION

The present invention relates to posture training. The words "posture training" as used herein are intended to be given a broad interpretation, to encompass, for example, "posture control."

A variety of circumstances can lead to the deterioration of a person's posture. One such circumstance is disease such as osteoporosis or neurological disease. Work or study positions, such as bending over a computer, a work table, a desk or a machine, for example, can lead to deteriorated posture in children and adults. Pregnant women, women with heavy anatomy at the anterior chest, or women with balance problems due to kyphosis can develop poor posture.

Present treatment for such posture disorder focuses on the use of restraints to hold a desired posture position. Such restraints include thoracolumbar supports and shoulder orthoses. The thoracolumbar support is basically a corset device The shoulder orthoses are devices which use a back brace in combination with a thoracic band and clavicle straps to hold the preferred posture position. However, the rigid restraint of these devices does not encourage the wearer to actively use his or her muscles to achieve good posture.

Further, because at least a portion of such devices wrap around the thoracic cavity and/or abdomen, they are uncomfortable for the patient. In treating osteoporosis, such devices which incorporate a rigid member can cause further damage to the frail skeletal structure. The restraining clavicle straps of the thoracolumbar supports are also uncomfortable. The discomfort aspect of such devices diminishes their effectiveness as the patient will avoid using an uncomfortable device.

SUMMARY OF THE INVENTION

The posture training support of the present invention presents a unique approach to posture training treatment by using a small pouch to position a weight on the back of the patient, below the inferior angle of the patient's scapulae. The pouch is held in place by adjustable clavicle straps and can be worn under the patient's clothing.

The support of the present invention does not use the restraint approach of the prior art. The invention uses a biomechanical approach to appropriately position a weight to counteract the patient's tendency to stoop forward and allows the design of a significantly more comfortable support which in turn is more likely to be used by the patient.

These and other objects, advantages and features of the present invention will become apparent upon review of the following specification in conjunction with the drawings.

DESCRIPTION OF THE PREFERRED EMBODIMENT

Figure 1:
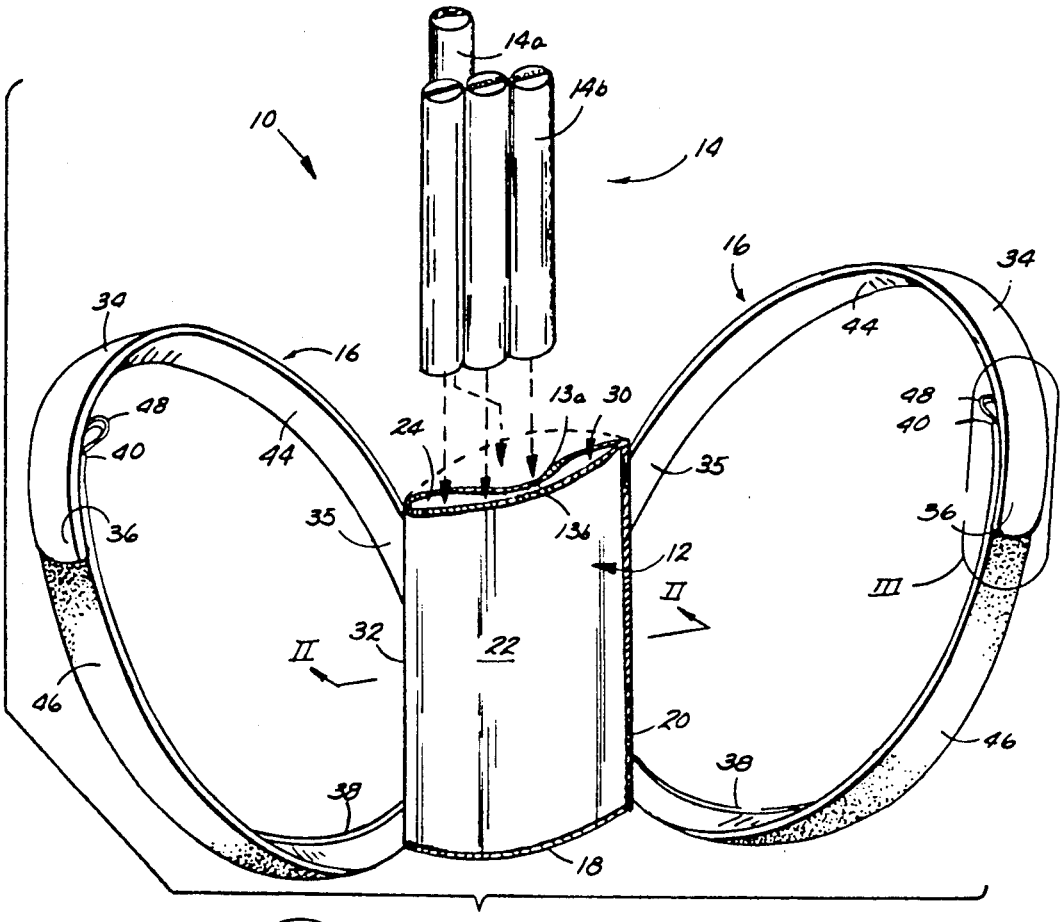
FIG. 1 is a frontal perspective view of the support of the present invention and shows the method of adding weight to the invention with the pouch shown in the open position in phantom.

In the preferred embodiment, the posture training support 10 of the present invention has a pouch 12 for holding weights 14 and clavicle straps 16 for securing the pouch 12 and weights 14 to the back of a patient (FIG. 1).

Pouch 12 is preferably made of a single piece of soft, durable material, such as a relatively thick, spongy material, with a loop pile surface to give a soft feel. The material is folded over itself and sewn along two sides 18 and 20 to form the rectangular pouch 12 with open top 30 (FIG. 1).

Figure 2:
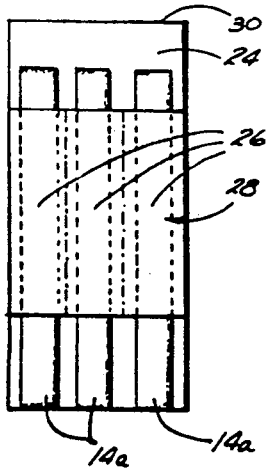
FIG. 2 is a sectional view of the pouch as indicated by section line II—II in FIG. 1.

Pouch 12 has a front portion 22 which lies against the back of a patient in use and a back portion 24 which faces away from the patient in use. Weight pockets 26 are provided on the inside surface of back portion 24 for holding individual weights **14*a* (FIG. 2). Weight pockets 26 are formed by sewing a band of elastic material 28 to the inside surface of back portion 24 so that equal loops are formed in the elastic material 28 to define the weight pockets 26**.

Pouch 12 is small and thin so as to be unobtrusive when worn. Its length and width define an area which is preferably significantly smaller than the area of a median adult back, indeed preferably less than one-half such back area and most preferably less than one-quarter such back area. One a larger back, pouch 12 nestles into the space between the lower portions of the shoulder blades. Pouch 12 is from about 4 to 8 inches long, about 2 to 4 inches wide, and no thicker than about 0.5 inch when empty and about 1.5 inches when filled with weights 14. A most preferred length is about 7 inches and a most preferred width is about 3.5 inches. Pouch 12 preferably has some thickness when empty in that pouch 12 is prefereably made of a soft cushiony material for comfort.

Pouch 12 includes a hook **13*a* and loop 13*b* closure system at open top 30 so that weights 14 which are placed in pouch 12 do not bounce out or otherwise work their way out of pouch 12** when walking vigorously or running.

Individual weights **14*a* are secured in pockets 26 (FIG. 2). The large, multiple weight 14*b* does not need to be secured in pockets 26. When weight 14*b* is used, it is simply placed inside pouch 12 (FIG. 1). Each weight 14 is preferably a relatively soft, pliable weight, such as can be made by filling a fabric pocket with metallic pellets, so that the weights 14 will conform to the surface of the patient's back to enhance comfort. Further, when individual weights 14*a* are used in combination with the multiple weight 14*b*, the multiple weight 14*b* is preferably positioned near the patient's back and the individual weights 14*a*** positioned away from the patient's back for enhanced comfort.

Each individual weight **14*a* weighs approximately 4 ounces. Multiple weight 14*b* preferably weighs about 16 ounces. Thus, the weight is adjustable in 0.25 pound increments to a total of about 1.75. Obviously, some variation in these weights is permissible within the broader aspects of the invention. You could, for example, simply use two 1-pound weights in pouch 12**.

Figure 3:
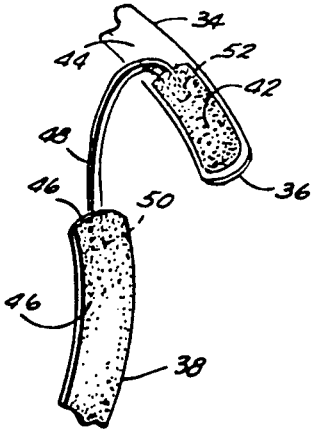
FIG. 3 is a detailed view of the strap adjustment means as indicated by detail III in FIG. 1.

Clavicle straps 16 are attached to pouch 12 near the top 30 and the bottom 18 of each side 20 and 32 (FIG. 1). Each strap 16 has an upper portion 34 which has an end 36, away from pouch 12, and a lower portion 38 which has an end 40, away from pouch 12. A patch 42 of the hook portion of a hook and loop fastening fabric is attached to the inner surface 44 at end 36 of each upper portion 34 (FIG. 3). The outer surface 46 of each lower portion 38 is provided with a loop pile material for fastening engagement with hook patch 42. An elastic tether 48 is fastened on each strap 16. Each tether 48 has a first end 52 fastened to each upper portion 34 near the edge of hook patch 42 away from end 36 (FIG. 3). The second end 50 of tether 48 is attached at the end 40 of each lower portion 38. In the preferred embodiment, tether 48 is approximately 4 inches long and stretches to approximately 9 inches.

The pouch 12 is properly positioned preferably just below the inferior angle of the scapulae on the back of the patient. Such proper positioning is accommodated in a range of patient sizes by the adjustability of straps 16. The use of hook patch 42 and the loop pile material on the outer surface 46 of each lower portion 38 provides a comfortable adjustment range for each strap of approximately 6 inches. Further, a range of sizes of straps is provided, such as double extra small, with lengths of approximately 9.75 inches and 13.75 inches for the upper and lower portions 34 and 38 respectively, through extra large, with lengths of approximately 13.75 inches and 17.75 inches for the upper and lower portions 34 and 38 respectively. Thus, support 10 can be used for a large range of patient sizes with some variation permissible within the broader aspects of the invention.

In use, a combination of weights 14 is selected by the treating physician for the appropriate amount of weight to treat a specific patient. Individual weights 14*a* are secured in weight pockets 26 of pouch 12 (FIG. 2). A multiple weight 14*b* is simply placed inside pouch 12 and does not need to be secured in weight pockets 26 (FIG. 1).

The patient wears support 10, under his or her clothing, by inserting his or her arms through clavicle straps 16 with ends 36 and 40 separated. Elastic tethers 48 keep ends 36 and 40 in proximity to each other and thereby make it easier to fasten ends 36 and 40 of straps 16, once straps 16 are in place over the patients arms. The fact that tethers 48 are elastic, makes it easier for the patient to position and fasten the straps 16. Pouch 12, containing weights 14, is positioned below the inferior angle of the patient's scapulae and the clavicle straps 26 are adjusted for the patient's comfort to secure pouch 12 in the proper position. This adjustment is easily accomplished by varying the point at which hook patch 42 is lapped over the loop pile of surface 46.

The above description is considered that of the preferred embodiment only. Modifications of the invention will occur to those who make or use the invention. Therefore, it is understood that the embodiments shown in the drawings and described above is merely for illustrative purposes and is not intended to limit the scope of the invention, which is defined by the following claims, as interpreted according to the principles of patent law.

The embodiments of the invention in which an exclusive property or privilege is claimed are defined as follows:

1. A posture training support consisting essentially of:

a rectangular pouch adapted to be worn on the back of a patient, said pouch having an approximate length and width of no greater than about eight inches and no greater than about four inches, respectively, said pouch having a thickness sufficiently thin that said pouch can be unobtrusively worn under the patient's clothing;

weight means located in said pouch; and relatively thin and narrow clavicle straps secured to said pouch and adapted to locate said pouch below the inferior angle of the patient's scapulae.

2. The support defined in claim 1 wherein said pouch includes an open top whereby said weight can removed from said pouch.

3. The support defined in claim 2 wherein said straps are adjustable for properly positioning said pouch.

4. The support defined in claim 3 wherein said straps include a hook and loop fastening fabric for adjusting said straps.

5. The support defined in claim 4 in which two weights are removably located in said pouch whereby the amount of weight in said pouch can be adjusted.

6. The support defined in claim 5 in which said open top of said pouch includes closure means whereby said weight is held in place within said pouch.

7. The support defined in claim 6 in which said pouch is about seven inches long by about three and one-half inches wide.

8. The support defined in claim 7 in which said pouch is no thicker than about one and one-half inches when filled with said weights.

9. The support defined in claim 2 in which two weights are removably located in said pouch whereby the amount of weight in said pouch can be adjusted.

10. The support defined in claim 9 in which said open top of said pouch includes closure means whereby said weight is held in place within said pouch.

11. The support defined in claim 9 wherein said straps are adjustable for properly positioning said pouch.

12. The support defined in claim 11 in which said open top of said pouch includes closure means whereby said weight is held in place within said pouch.

13. The support defined in claim 1 wherein said straps are adjustable for properly positioning said pouch.

14. The support defined in claim 1 in which said pouch is no thicker than about one and one-half inches when filled with said weight mean.

15. The support defined in claim 1 in which said pouch is about seven inches long by about three and one-half inches wide.

16. The support defined in claim 15 in which said pouch is no thicker than about one and one-half inches when filled with said weight means.

17. A posture training device to be worn on the back of a patient, consisting essentially of:

a pouch open along an upper end and having first and second interior walls, said pouch having dimensions so as to lie in close conformity with the patient's back and be unobtrusively worn under the patient's clothing;

weight means disposed within said pouch through said open end, said weight means having a shape adapted to remain within said pouch in a substantially preferred orientation;

means disposed within the opening along the upper end of the pouch and attached to said first and second interior walls for sealing said pouch; and a first and a second clavicle strap assembly secured to said pouch for locating said pouch below an inferior angle of the patient's scapulae.

* * * * *

UNITED STATES PATENT AND TRADEMARK OFFICE

CERTIFICATE OF CORRECTION

PATENT NO. : 5,120,288

DATED : June 9, 1992

INVENTOR(S) : Mehrsheed Sinaki

It is certified that error appears in the above-identified patent and that said Letters Patent is hereby corrected as shown below:

Column 1, line 23:
After "device" insert --.--.

Column 2, line 29:
"One a" should be --On a--.

Column 4, line 8:
After "can" insert --be--.

Column 4, line 42, claim 14:
"mean" should be --means--.

Signed and Sealed this

Twelfth Day of October, 1993

Bruce Lehman

*Attest:*

BRUCE LEHMAN

*Attesting Officer*

*Commissioner of Patents and Trademarks*